US005787827A

United States Patent [19]

Tsukahara

[11] Patent Number: 5,787,827

[45] Date of Patent: Aug. 4, 1998

[54] FABRIC FEED DIRECTION REVERSING DEVICE FOR SEWING MACHINE AND CONTROL MEANS THEREFOR

[75] Inventor: Hisaaki Tsukahara, Tokyo, Japan

[73] Assignee: Mitsubishi Denki Kabushiki Kaisha, Tokyo, Japan

[21] Appl. No.: 841,685

[22] Filed: Apr. 30, 1997

[30] Foreign Application Priority Data

Nov. 28, 1996 [JP] Japan ..... 8-317977

[51] Int. Cl.[6] ..... D05B 19/00; D05B 69/18

[52] U.S. Cl. ..... 112/470.01; 112/275; 112/317; 112/475.01

[58] Field of Search ..... 112/275, 277, 112/317, 316, 451, 470.01, 475.01

[56] References Cited

U.S. PATENT DOCUMENTS 4,154,179 5/1979 Arnold ..... 112/317
4,660,483 4/1987 Yamauchi ..... 112/317
4,781,134 11/1988 Horie ..... 112/317 X

FOREIGN PATENT DOCUMENTS 63-267395 11/1988 Japan .
4-26496 1/1992 Japan .

*Primary Examiner*—Peter Nerbun
*Attorney, Agent, or Firm*—Sughrue, Mion, Zinn, Macpeak & Seas, PLLC

[57] ABSTRACT

A fabric feed direction reversing device for a sewing machine having a reversing mechanism that switches a sewing object feed direction includes a control means that stops a needle at an upper position or a lower position by controlling a sewing machine drive motor based on a sewing object feed direction reversing command generated from a feed reverse command section, and that operates the reversing mechanism after the needle has stopped, and that operates the sewing machine drive motor after the reversing mechanism operation has been completed.

10 Claims, 8 Drawing Sheets

FABRIC FEED DIRECTION REVERSING DEVICE FOR SEWING MACHINE AND CONTROL MEANS THEREFOR

BACKGROUND OF THE INVENTION

1. Field of the Invention

The present invention relates to an improved fabric feed direction reversing device for a sewing machine that can make, e.g., finishing reverse stitches smoothly by sewing a fabric, which is an object to be sewn, while feeding the fabric in a direction opposite to an initial fabric feed direction (hereinafter referred to as "reverse feeding").

2. Description of the Related Art

A conventional fabric feed direction reversing device for sewing machine will be described with reference to FIG. 4. In FIG. 4, the conventional fabric feed direction reversing device for a sewing machine includes: a sewing machine main body 1; a reversing mechanism 2; a sewing machine drive motor 7; a motor drive section 9; a needle position detector 11; a reversing mechanism drive section 13; a feed reverse command section 16; and a switch 18. The reversing mechanism 2 is arranged inside the sewing machine main body 1, can feed a fabric in both a forward direction and a reverse direction, and can not only switch the fabric feed direction but also reverse the fabric. The sewing machine drive motor 7 drives a needle 3 so that the needle 3 moves up and down through a pulley 5 and the like. The motor drive section 9 controls and drives the sewing machine drive motor 7. The needle position detector 11 serves as a needle position detecting means and detects an upper or lower position as well as a stopped condition of the needle 3. The reversing mechanism drive section 13 drives a solenoid (not shown) of the reversing mechanism 2. The feed reverse command section 16 automatically supplies a command to the reversing mechanism drive section 13. The switch 18 serves as a manual feed reverse command section that supplies an ON or OFF command to the feed reverse command section 16.

The reversing mechanism 2 is available in two types: an upper position type that reversely feeds a fabric under the condition that the needle 3 is at the upper position as shown in FIG. 5A; and a lower position type that reversely feeds the fabric under the condition that the needle 3 is at the lower position with the needle 3 penetrating the fabric as shown in FIG. 5B.

The upper position type reversing mechanism 2 will be described with reference to FIGS. 6 and 7. In FIGS. 6 and 7, the upper position type reversing mechanism 2 includes: a feed bar 102; a feed rock shaft 104 and a feed lifting rock shaft 106; a feed forked connection 108; a crank connecting rod 110; an arm shaft 124; an eccentric cam 122; and a feed regulating lever 114. The feed bar 102 has a fabric feed dog 100 secured thereto. The feed rock shaft 104 and the feed lifting rock shaft 106 are secured to an end portion of the feed bar 102 and give to the feed dog 100 a horizontal motion and a vertical motion. The feed forked connection 108 has one end thereof coupled to the feed rock shaft 104 by a pin 109 so that an oscillating motion can be given to the feed dog 100, and has a recess 108*a* engaged with a sleeve 120, the recess 108*a* being formed on the other end. The crank connecting rod 110 similarly has one end thereof coupled to the feed lifting rock shaft 106 and has the other end thereof secured to a ring 126 that is fitted with the arm shaft 124. The arm shaft 124 has the sleeve 120 secured thereto. The eccentric cam 122 is engaged with the arm shaft 124. The feed regulating lever 114 has a feed regulating stud 112 and a feed regulator 116 fixed to the feed forked connection 108 through a link 118 and determines the feed direction of the feed dog 100 fitted with a lower end portion of the feed regulator 116. The feed regulating stud 112 and the feed regulator 116 regulate stitch length. It may be noted that a not shown solenoid is connected to the feed regulating lever 114, the solenoid serving as a drive source.

In this reversing mechanism 2, the respective parts thereof are constructed as shown in FIG. 6 and the whole part thereof is constructed as shown in FIG. 7. When the feed regulating lever 114 is set to a feed stop position Ps, the feed bar 102 is stopped. When the feed regulating lever 114 is set to a forward stitch position Pp, the feed bar 102 feeds a fabric in the forward direction while moving so as to depict an elliptic locus counterclockwise. When the feed regulating lever 114 is set to a reverse stitch position Pr, the feed bar 102 feeds the fabric in the reverse direction while moving so as to depict the elliptic locus clockwise.

Finishing reverse stitching operation shown in FIG. 9 using the thus constructed fabric feed direction reversing device for a sewing machine will be described next with reference mainly to a time chart shown in FIG. 8. The operation will be described in the case of generating a feed reverse signal automatically and in the case of generating a feed reverse signal manually.

First, the case of sewing a fabric by automatically generating a feed reverse signal will be described. It is assumed that at a timing $t_1$, the needle 3 is moving vertically with the sewing machine drive motor 7 being rotated and that a fabric is being sewn from point 0 toward point A1 in FIG. 9. Under this condition, the feed reverse command section 16 generates a feed reverse ON signal to the reversing mechanism drive section 13 at a timing $t_5$ that is some distance before the sewing direction turning point A1 in FIG. 9, and an operation command is generated to the solenoid that drives the feed regulating lever 114. Then, as shown in FIG. 7, the feed regulating lever 114 moves from position Ps to position Pr to thereby operate the feed rock shaft 104 and the feed lifting rock shaft 106 through the feed regulator 116 and the link 118 after a time td elapses from the generation of the feed reverse command. As a result, the feed bar 102 moves so as to depict the elliptic locus clockwise, so that the fabric is sewn by the needle 3 while being fed in the reverse direction from point A1 in FIG. 9.

That is, the reversing mechanism 2 is operated when the needle 3 is right at the upper position, taking into consideration both the timing at which the reversing mechanism 2 operates from the generation of the feed reverse signal and the vertically moving speed of the needle 3.

Then, the case of sewing the fabric by manually generating a feed reverse signal will be described. While the fabric is being sewn from point 0 toward point A1 in FIG. 9, the operator turns the switch 18 on at a timing $t_3$ so that an auxiliary feed reverse command is supplied to the feed reverse command section 16, and after the fact that the needle 3 is at the upper position is detected by a pulse signal of the needle position detector 11, the pulse signal being a falling signal from "high" to "low", a feed reverse signal is supplied to the solenoid at timing $t_5$ that is the same as in the case of automatically generating a feed reverse signal. The same operation as in the case of automatic reverse stitching is then performed.

Since the conventional fabric feed direction reversing device for a sewing machine is constructed as described above, the needle 3 fails to come to the upper position, depending on variations in the operation timing td of the reversing mechanism 2 including the solenoid. Therefore, there has been a problem that the reversing mechanism 2 comes in contact with the needle 3 so that the needle 3 is likely to be broken.

Further, when the vertically moving speed of the needle 3 is changed to change the stitch distance, the timing at which the needle 3 comes to the upper position is changed. As a result, the feed reverse command generating timing must be changed based on the sewing direction turning point, which has addressed a second problem that the operation becomes complicated.

SUMMARY OF THE INVENTION

The object of the present invention is to provide a fabric feed direction reversing device for a sewing machine that, in the case of operating the reversing mechanism that reversely feeds a fabric, not only prevents breakage of a needle but also eliminates the need for changing the feed reverse command generating timing even if the moving speed of the needle is changed.

The invention is applied to a fabric feed direction reversing device for a sewing machine that has a sewing machine drive motor for operating a needle up and down, a feed reverse command section for supplying a command for switching a sewing object feed direction to an opposite direction, and a reversing mechanism for switching the sewing object feed direction on condition that the needle is at an upper position or a lower position. Such fabric feed direction reversing device for a sewing machine further includes: a control means that stops the needle at the conditioned position by controlling the sewing machine drive motor based on the sewing object feed direction reversing command generated from the feed reverse command section, and that operates the reversing mechanism after the needle stops, and that operates the sewing machine drive motor after the reversing mechanism operation is completed.

BRIEF DESCRIPTION OF THE DRAWINGS

The above and other objects and features of the present invention will be more apparent from the following description taken in conjunction with the accompanying drawings. In the accompanying drawings.

DETAILED DESCRIPTION OF THE PREFERRED EMBODIMENTS

Figure 1:
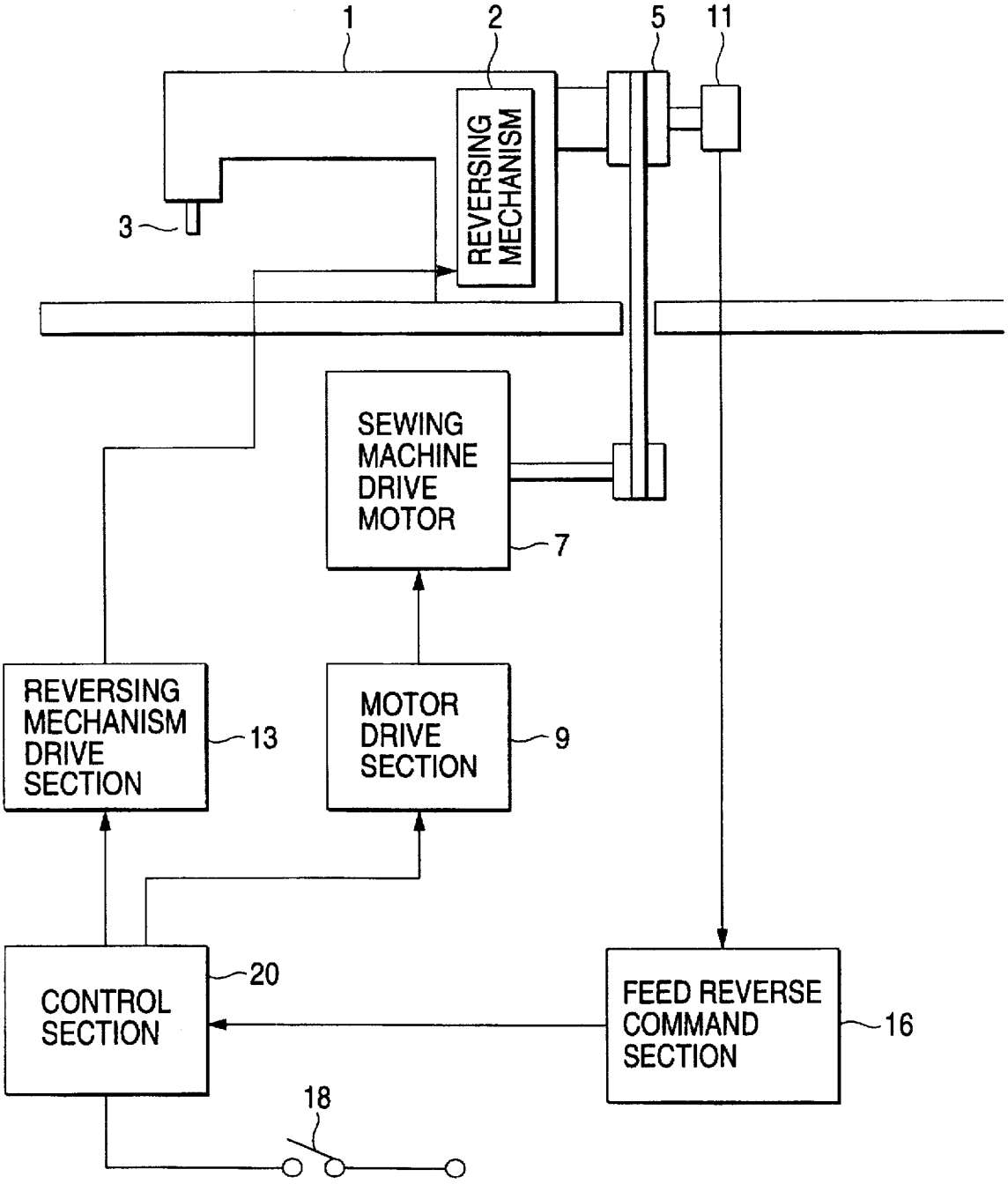
FIG. 1 is a diagram showing a construction of a fabric feed direction reversing device for a sewing machine, which is a mode of embodiment of the present invention.

A mode of embodiment of the present invention will now be described with reference to FIG. 1. FIG. 1 is a diagram showing a construction of a fabric feed direction reversing device for a sewing machine. In FIG. 1, since the same reference numerals are given to the same or like parts and components as those of the conventional example, their descriptions will be omitted.

In FIG. 1, reference numeral 20 denotes a control section serving as a control means. The control section 20 supplies a signal to a motor drive section 9 after a feed reverse command is generated from a feed reverse command section 16. This signal is supplied to stop a needle 3 at an upper position or a lower position. After a needle position detector 11 detects the needle 3 being at the upper position or the lower position, the control section 20 supplies the feed reverse command to a reversing mechanism drive section 13, and drives a sewing machine motor 7 through the motor drive section 9 after a predetermined time elapses to thereby operate the needle 3. It may be noted that by the "upper position" it is intended to mean a position at which the needle 3 comes above the confronting surface of a fabric while having a distance with respect to such surface of the fabric. The "upper position" corresponds to upper position type reverse feeding. By the "lower position" it is intended to mean a position at which the needle 3 penetrates the fabric. The "lower position" corresponds to lower position type reverse feeding.

Figure 2:
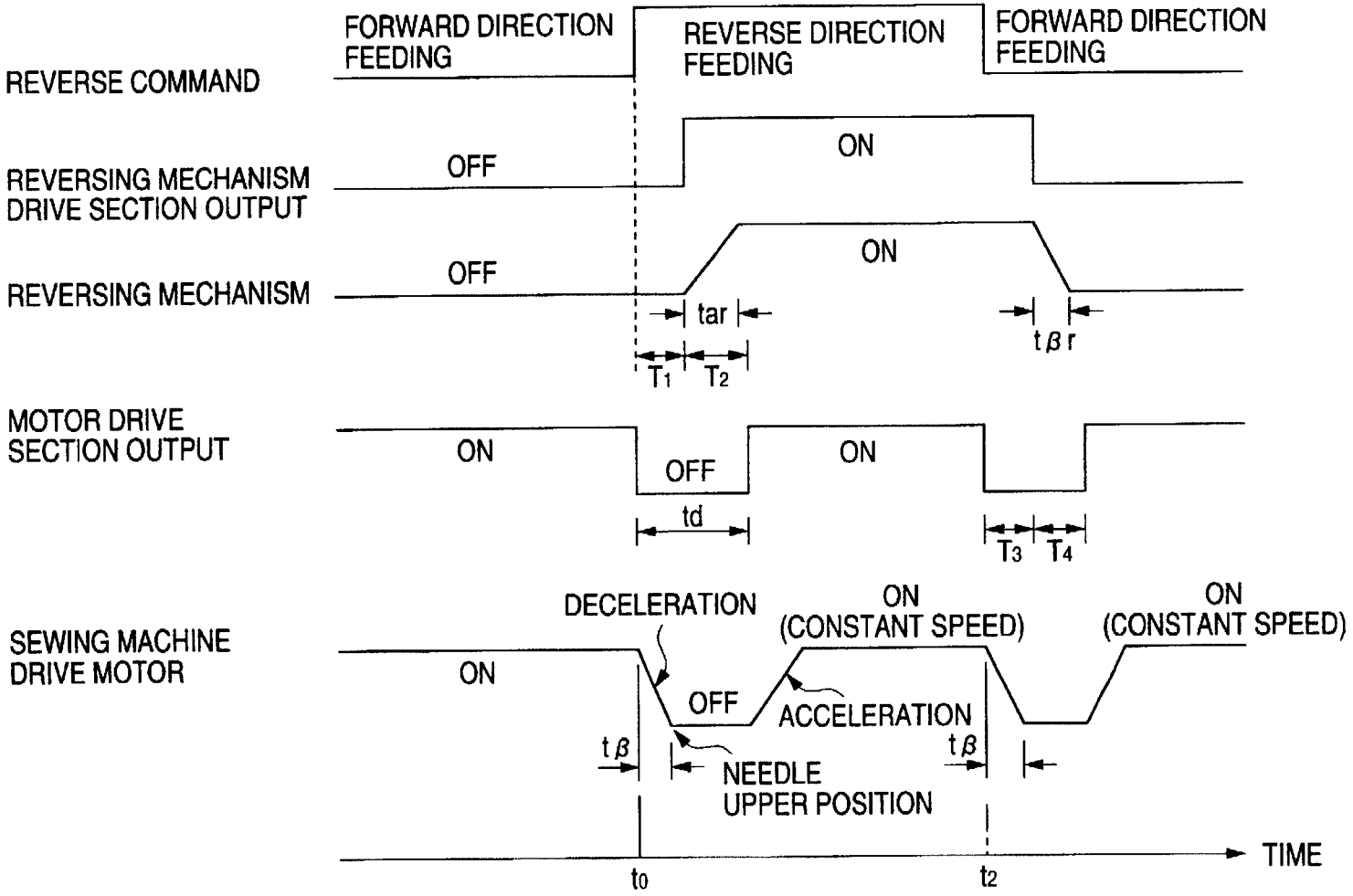
FIG. 2 is a time chart of various parts in the fabric feed direction reversing device for a sewing machine, which is mode of embodiment 1.
Figure 3:
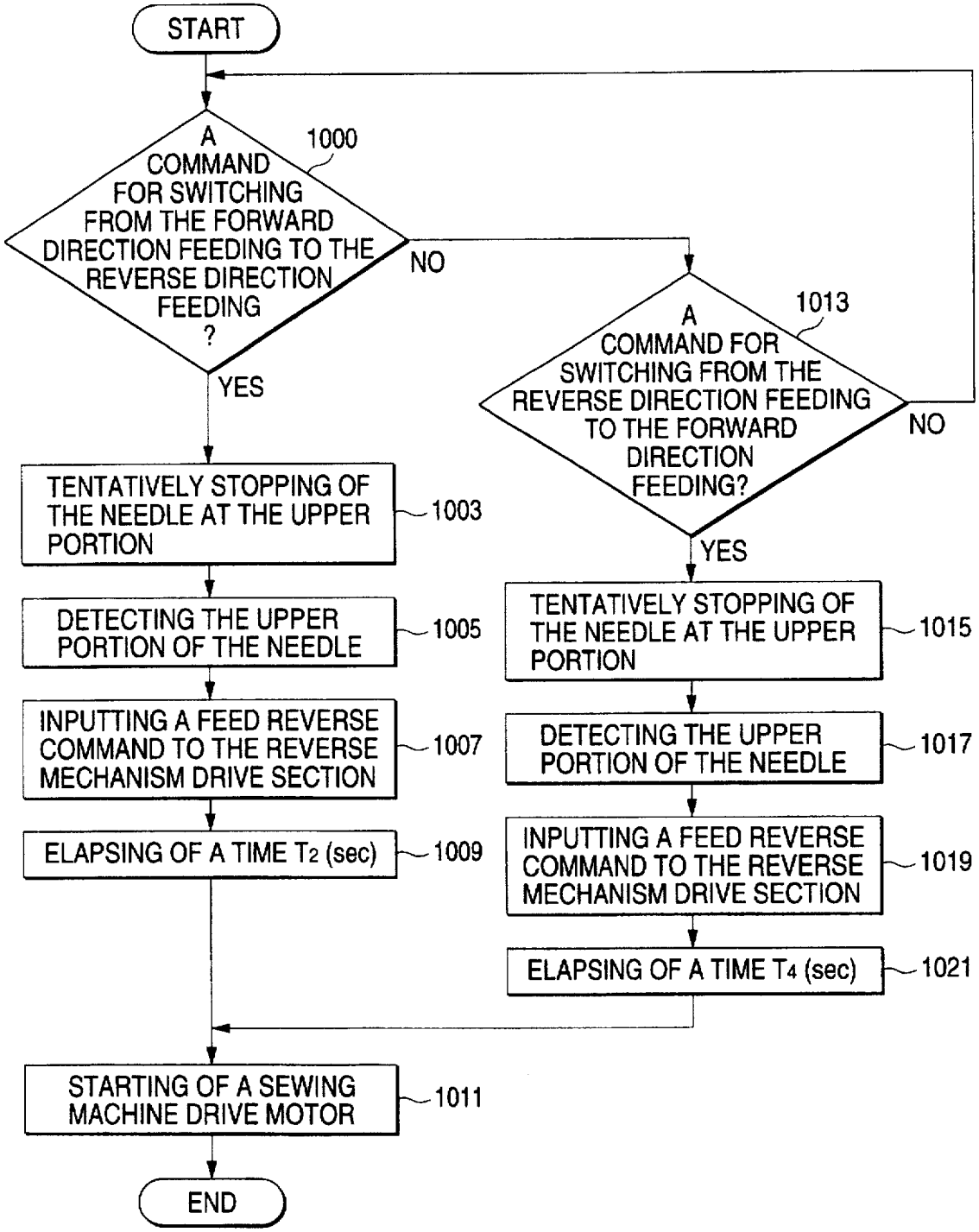
FIG. 3 is a flowchart for the fabric feed direction reversing device for a sewing machine, which is mode of embodiment 1.
Figure 4:
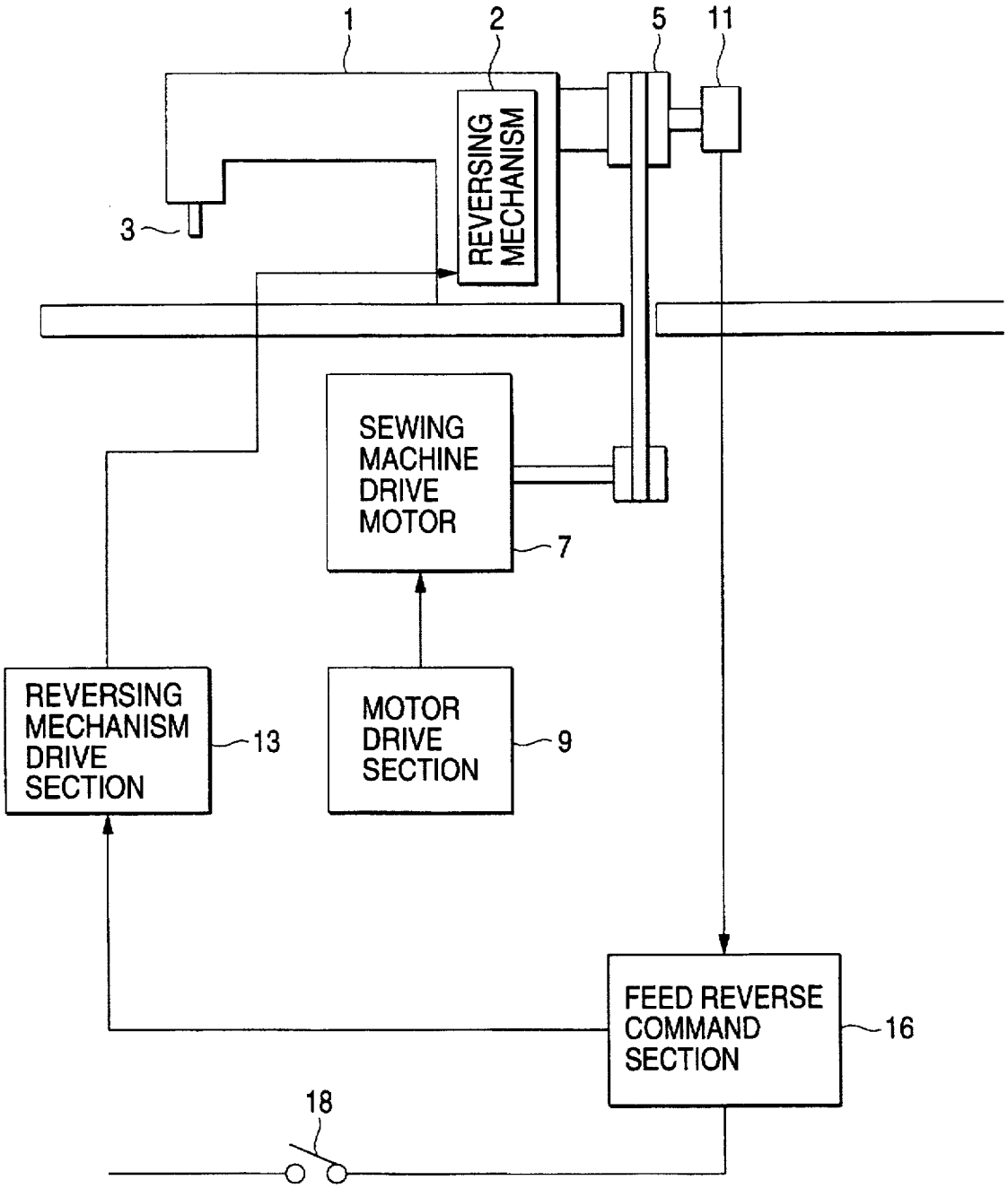
FIG. 4 PRIOR ART
FIG. 4 is a block diagram showing a conventional fabric feed direction reversing device for a sewing machine.
Figure 5A:
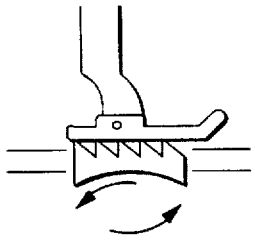
FIGS. 5A and 5B are schematic diagrams showing forms for feeding an object to be sewn.
Figure 5B:
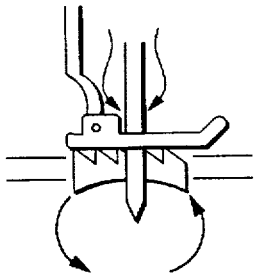
Figure 6:
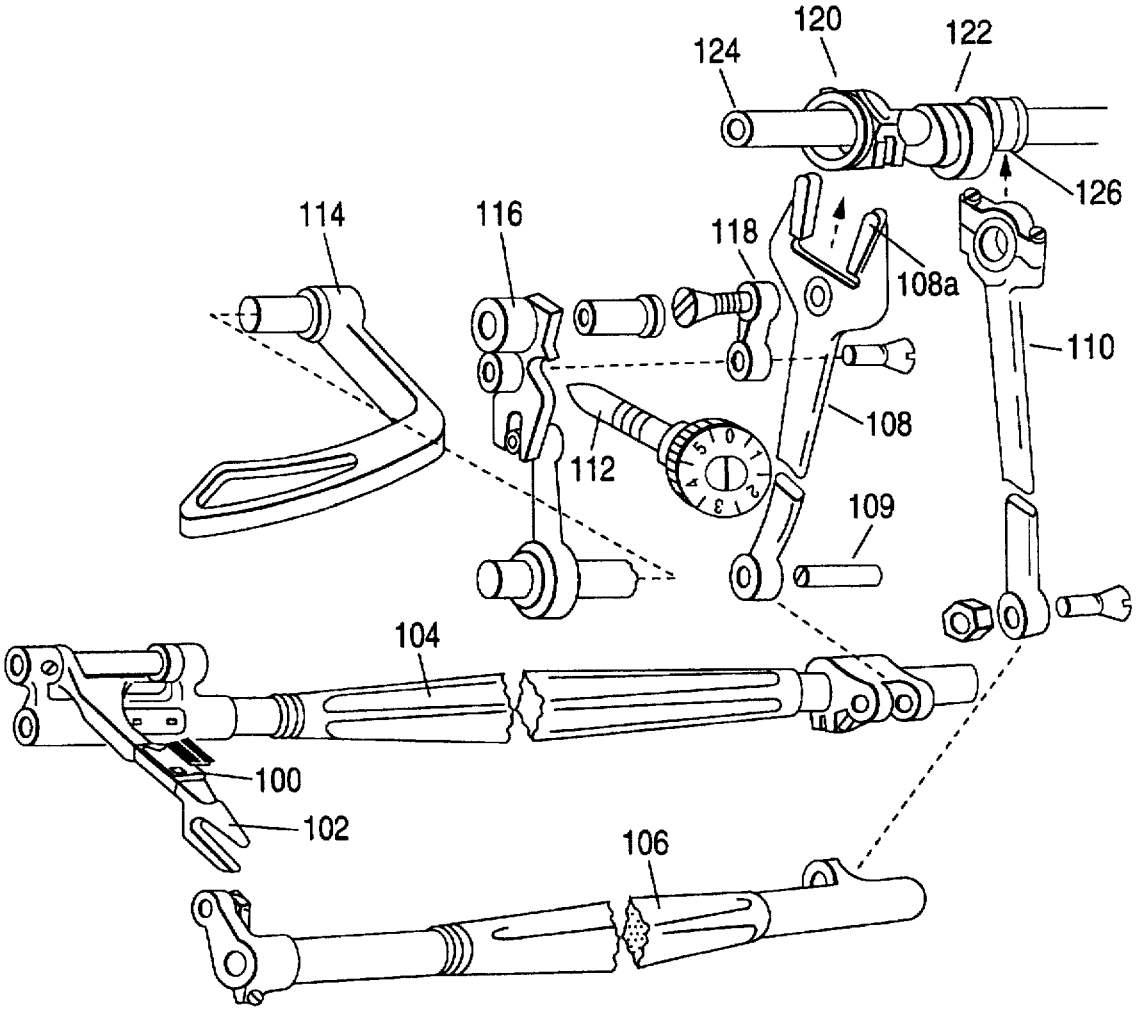
FIG. 6 is a perspective view showing a reversing mechanism.
Figure 7:
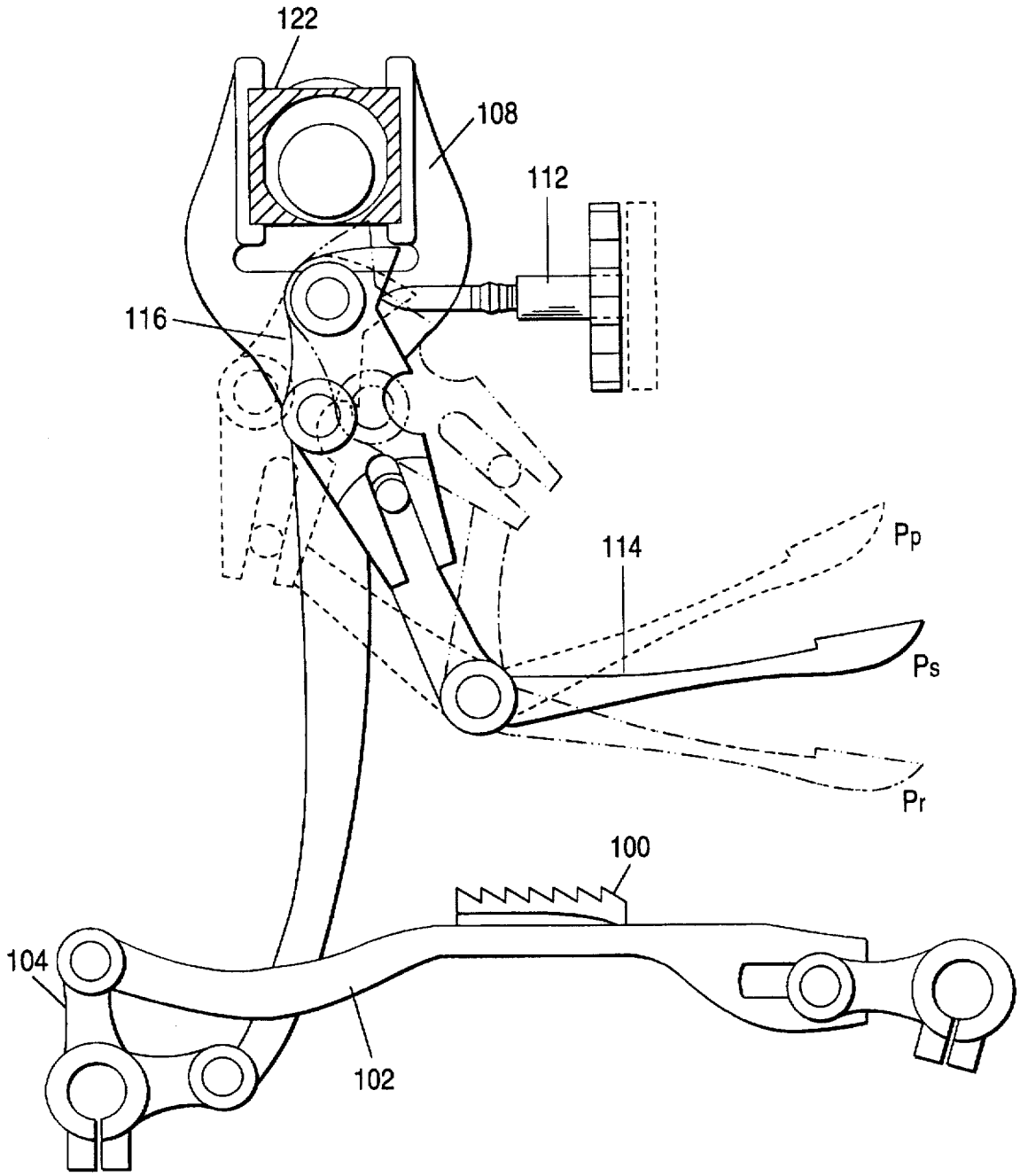
FIG. 7 is a front view of the reversing mechanism shown in FIG. 6.
Figure 8:
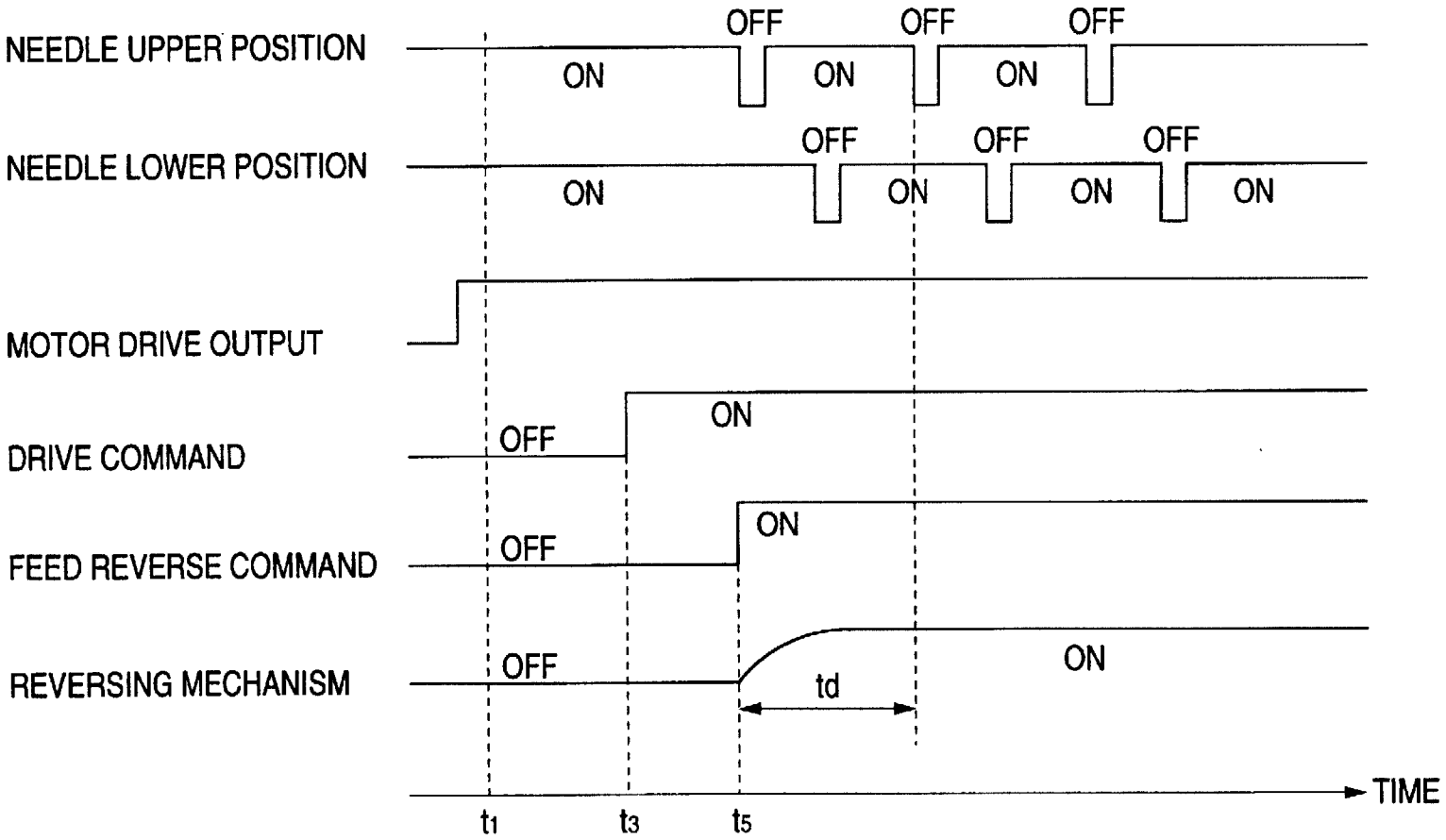
FIG. 8 is a time chart showing an operation of the conventional fabric feed direction reversing device for a sewing machine.

An operation of the thus constructed fabric feed direction reversing device for a sewing machine having the upper position type reversing mechanism will be described with reference to FIGS. 1 to 3 and FIG. 9. FIG. 2 shows a time chart of the fabric feed direction reversing device for a sewing machine, and FIG. 3 shows a flowchart for FIG. 1. It is assumed that at a timing $t_0$ in FIG. 2, the sewing machine motor 7 is rotating and that a fabric is being sewn from point 0 toward point A1 in FIG. 9. Under this condition, the control section 20 judges whether or not the feed reverse command section 16 generates an ON command that is a command for switching the fabric feed direction from the forward direction to the reverse direction slightly before the sewing direction turning point A1 in FIG. 9 (Step 1000). If the ON command is generated at timing $t_0$, the control section 20 supplies to the motor drive section 9 a command to stop the needle 3 at the upper position, and causes the needle 3 to tentatively stop at the upper position after a time tβ elapses from the generation of the ON command by driving the sewing machine drive motor 9 under control (Step 1003). The needle position detector 11 detects the stoppage of the needle 3 at the upper position (Step 1005). It may be noted that if the ON command is not generated in Step 1000, Step 1000 is repeated until the ON command is generated.

The control section 20 supplies to the reversing mechanism drive section 13 the feed reverse command that switches the fabric feed direction from the forward direction to the reverse direction (Step 1007), and causes the reversing mechanism 2 to complete the operation so that the reversing mechanism 2 gets ready to reversely feed the fabric after an operation time "tar" elapses from the generation of the feed reverse command. After a time T2 elapses from the generation of the feed reverse command to the reversing mechanism 2 (Step 1009), not only the reversing mechanism 2 starts feeding reversely the fabric, but also the control section 20 supplies to the motor drive section 9 a rotating command to cause the sewing machine drive motor 7 to rotate, so that the needle 3 moves vertically to sew the fabric from point A1 toward point A2 in FIG. 9 (Step 1011). It may be noted that time "tar"<time T2 must be satisfied.

While the aforementioned operation is the case where the fabric feed direction is switched from the forward direction to the reverse direction out of a plurality of feed reverse operations, an operation that switches the fabric feed direction from the reverse direction to the forward direction will be described next.

Both operations, being feed reverse operations, share a basic operation in common. However, since the operation times of the reversing mechanism 2 and the like are different, Steps 1013 to 1021 are arranged in the flowchart shown in FIG. 3.

Figure 9:
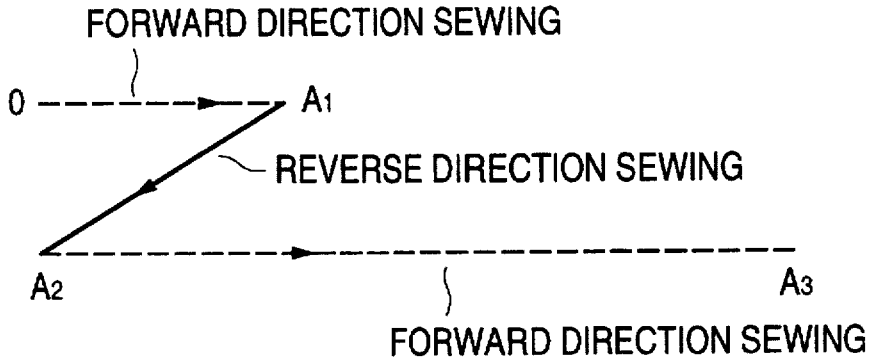
FIG. 9 is a diagram showing finishing reverse stitches.

At a timing $t_2$ in the time chart shown in FIG. 2, the sewing machine drive motor 7 is rotating, and a fabric is being sewn from point A1 toward point A2 in FIG. 9. Under this condition, the control section 20 judges whether or not the feed reverse command section 16 generates an ON command that is a command for switching the fabric feed direction from the reverse direction to the forward direction slightly before the sewing direction turning point A2 in FIG. 9 (Step 1013). If the ON command is generated at timing $t_2$, the control section 20 supplies to the motor drive section 9 a command to stop the needle 3 at the upper position, and causes the needle 3 to tentatively stop at the upper position after the time tβ elapses from the generation of the ON command by driving the sewing machine drive motor 9 under control (Step 1015). The needle position detector 11 detects the stoppage of the needle 3 at the upper position (Step 1017). It may be noted that if the ON command is not generated in Step 1013, the control section 20 returns to Step 1000.

The control section 20 supplies to the reversing mechanism drive section 13 the feed reverse command that switches the fabric feed direction from the reverse direction to the forward direction (Step 1019), and causes the reversing mechanism 2 to complete the operation so that the reversing mechanism 2 gets ready to reversely feed the fabric after an operation time "tβr" elapses from the generation of the feed reverse command. After a second operation time T4 that is slightly longer than the operation time "tβr" elapses (Step 1021), not only the reversing mechanism 2 starts feeding reversely the fabric, but also the control section 20 supplies to the motor drive section 9 a rotating command to cause the sewing machine drive motor 7 to rotate, so that the needle 3 moves vertically to sew the fabric from point A2 toward point A3 in FIG. 9 (Step 1011).

While it is after the needle position detector 11 detects the needle 3 being in stoppage at the upper position that the control section 20 proceeds to next steps in Steps 1005, 1017, these Steps 1005, 1017 may be omitted and Step 1007 or 1019 may be executed after T1 seconds, which is the first time from the generation of the fabric feed reverse command (the time T1 is slightly longer than the decelerating time tβ of the sewing machine drive motor 7) elapses.

Further, while the sewing machine drive motor 7 is driven after the predetermined times T2, T4 elapse in Steps 1009, 1021, the sewing machine drive motor 7 may, of course, be driven in Step 1011 after the completion of the reversing mechanism 2 operation is detected, e.g., by a mechanical sensor.

Further, while the control section 20 and the like are operated after a feed reverse command is generated automatically from the feed reverse command section 16 (Step 1000), the feed reverse command may be supplied to the control section 20 and the like based on an ON signal of a switch 18 instead of Step 1000.

Further, a feed reverse command may be generated when it is judged that a predetermined number of stitches are made by counting the number of stitches. Still further, while the aforementioned description refers to the upper position type reversing mechanism, the same can, of course, be supplied to a lower position type reversing mechanism as long as the upper position in Steps 1003, 1005, 1015, 1017 is read as the lower position.

As described in the foregoing, according to the first aspect of the invention, a fabric feed direction reversing device for a sewing machine includes a control means that stops a needle at an upper position or a lower position by controlling a sewing machine drive motor based on a sewing object feed direction reversing command generated from a feed reverse command section, and that operates a reversing mechanism after the needle stops, and that operates the sewing machine drive motor after the reversing mechanism operation is completed. Therefore, the present invention can provide the advantage that not only breakage of the needle can be prevented, but also it is no longer necessary to change the timing at which the feed reverse command section generates a feed reverse command even if the operating speed of the needle is changed.

According to the second aspect of the invention, the needle stops at the upper position or the lower position after a first time elapses, the first time being between a timing at which a command from the feed reverse command section is generated and a timing at which the needle moves to the upper position or the lower position, in addition to the advantage provided by the first aspect of the invention. Therefore, the present invention can provide the advantage that the construction of the control means can be simplified.

According to the third aspect of the invention, the completion of the reversing mechanism operation is detected after a second time elapses, the second time being a time between a timing at which a command is generated from the feed reverse command section and a timing at which the reversing mechanism is operated, in addition to the advantage provided by the first aspect of the invention. Therefore, the present invention can provide the advantage that the construction of the control means can be simplified.

The foregoing description of a preferred embodiment of the invention has been presented for purpose of illustration and description. It is not intended to be exhaustive or to limit the invention to the precise form disclosed, and modifications and variations are possible in light of the invention. The embodiment was chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A fabric feed direction reversing apparatus for a sewing machine comprising:

sewing machine drive means for operating a needle up and down;

feed reverse command means for generating a switching command for switching a sewing object feed direction to an opposite direction;

reversing means for switching the sewing object feed direction on a condition that said needle is at a predetermined position; and control means for stopping said needle at said predetermined position by controlling said sewing machine drive means based on said switching command generated from said feed reverse command means, operating said reversing means after operation of said needle is terminated, and operating said sewing machine drive means after completion of switching the sewing object feed direction.

2. A fabric feed direction reversing apparatus for a sewing machine according to claim 1, wherein said predetermined position is an upper position or lower position.

3. A fabric feed direction reversing apparatus for a sewing machine according to claim 2, wherein said reversing means operates after a first period elapses, said first period being between a first timing at which said switching command is generated from said feed reverse command means and a second timing at which said needle is moved to said predetermined position.

4. A fabric feed direction reversing apparatus for a sewing machine according to claim 3, further comprising:

first detecting means for detecting whether said needle is stopped at said predetermined position;

wherein said reversing means is operated by said control means after said first detecting means detects said needle is at said predetermined position.

5. A fabric feed direction reversing apparatus for a sewing machine according to claim 2, wherein said sewing machine driving means operates after a second period elapses, said second period being between a first timing at which said switching command is generated from said feed reverse command means and a third timing at which said reversing means operation completes.

6. A fabric feed direction reversing apparatus for a sewing machine according to claim 5, further comprising:

second detecting means for detecting whether said reversing means operation completes;

wherein said sewing machine drive means is operated by said control means after said second detecting means detects completion of said reversing means operation.

7. A reverse direction sewing method for a sewing machine, comprising the steps of:

generating a command for switching a sewing object feeding direction to an opposite direction;

stopping a sewing machine drive motor to stop a needle at a predetermined position based on said command;

operating a reverse mechanism after said needle is stopped at said predetermined position; and operating a sewing machine drive motor after completion of operation of said reversing mechanism.

8. A reverse direction sewing method for a sewing machine according to claim 7, wherein said predetermined position is an upper position or a lower position.

9. A reverse direction sewing method for a sewing machine according to claim 8, further comprising the step of:

detecting when said needle reaches said predetermined position before said operating step of said reverse mechanism.

10. A reverse direction sewing method for a sewing machine according to claim 8, further comprising the step of:

detecting completion of operation of said reversing mechanism before said operating step of said sewing machine drive motor.

* * * * *